US005788001A

United States Patent [19]

Matthias et al.

[11] Patent Number: 5,788,001

[45] Date of Patent: Aug. 4, 1998

[54] ELEMENTS FACED WITH SUPERHARD MATERIAL

[75] Inventors: Terry R. Matthias, Longlevens, England; Alex Newton, Houston, Tex.

[73] Assignee: Camco Drilling Group Limited of Hycalog, Stonehouse, United Kingdom

[21] Appl. No.: 639,233

[22] Filed: Apr. 18, 1996

[51] Int. Cl.[6] ..... E21B 10/46

[52] U.S. Cl. ..... 175/432

[58] Field of Search ..... 175/420.2, 432, 175/434, 425, 428

[56] References Cited

U.S. PATENT DOCUMENTS

| | | | |
|---|---|---|---|
| 4,784,023 | 11/1988 | Dennis . | |
| 5,120,327 | 6/1992 | Dennis . | |
| 5,486,137 | 1/1996 | Flood et al. | 175/432 X |
| 5,590,728 | 1/1997 | Matthias et al. | 175/432 |
| 5,617,928 | 4/1997 | Matthias et al. | 175/432 |
| 5,622,233 | 4/1997 | Griffin | 175/432 |

FOREIGN PATENT DOCUMENTS

| | | |
|---|---|---|
| 2283772 | 5/1995 | United Kingdom . |
| 2283773 | 5/1995 | United Kingdom . |
| 2290327 | 12/1995 | United Kingdom . |

*Primary Examiner*—William P. Neuder

[57] ABSTRACT

A preform element, such as a cutting element for a rotary drag-type drill bit, includes a facing table of superhard material having a front face, a peripheral surface, and a rear surface bonded to a substrate which is less hard than the superhard material. The rear surface of the facing table is integrally formed with a plurality of ribs which project into the substrate, and at least major portions of the ribs extend across the rear surface of the facing table in directions which are generally radial with respect to at least one point which is adjacent or outside the peripheral surface of the facing table.

27 Claims, 2 Drawing Sheets

ELEMENTS FACED WITH SUPERHARD MATERIAL

BACKGROUND OF THE INVENTION

1. Field of the Invention

The invention relates to elements faced with superhard material, and particularly to preform elements comprising a facing table of superhard material having a front face, a peripheral surface, and a rear surface bonded to a substrate of material which is less hard than the superhard material.

2. Description of Related Art

Preform elements of superhard material are often used as cutting elements on rotary dragtype drill bits, and the present invention will be particularly described in relation to such use. However, the invention is not restricted to cutting elements for this particular use, and may relate to preform elements for other purposes. For example, elements faced with superhard material, of the kind referred to, may also be employed in workpiece-shaping tools, high pressure nozzles, wire-drawing dies, bearings and other parts subject to sliding wear, as well as elements subject to percussive loads as may be the case in tappets, cams, cam followers, and similar devices in which a surface of high wear resistance is required.

Preform elements used as cutting elements in rotary drill bits usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the surface of the substrate being brazed to a surface on the carrier, for example by a process known as "LS bonding". Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be molded using a powder metallurgy process.

Such cutting elements are subjected to extremes of temperature during formation and mounting on the bit body, and are also subjected to high temperatures and heavy loads when the drill is in use down a borehole. It is found that as a result of such conditions spalling and delamination of the superhard facing table can occur, that is to say the separation and loss of the diamond or other superhard material over the cutting surface of the table. This may also occur in preform elements used for other purposes, and particularly where the elements are subjected to repetitive percussive loads, as in tappets and cam mechanisms.

Commonly, in preform elements of the above type the interface between the superhard table and the substrate has usually been flat and planar. However, particularly in cutting elements for drill bits, attempts have been made to improve the bond between the superhard facing table and the substrate by configuring the rear face of the facing table so as to provide a degree of mechanical interlocking between the facing table and substrate.

One such arrangement is shown in U.S. Pat. No. 5,120,327 where the rear surface of the facing table is integrally formed with a plurality of identical spaced apart parallel ridges of constant depth. The facing table also includes a peripheral ring of greater thickness, the extremities of the parallel ridges intersecting the surrounding ring. U.S. Pat. No. 4,784,023 illustrates a similar arrangement but without the peripheral ring.

Other configurations of the rear face of the facing table are described in British Patent Specifications Nos. 2283772 and 2283773. The present invention relates to further developments in preform elements which may overcome at least some of the problems which arise with existing designs as well as providing other advantages.

SUMMARY OF THE INVENTION

According to the invention there is provided a preform element including a facing table of superhard material having a front face, a peripheral surface, and a rear surface bonded to a substrate which is less hard than the superhard material, the rear surface of the facing table being integrally formed with a plurality of ribs which project into the substrate, at least major portions of said ribs extending across the rear surface of the facing table in directions which are generally radial with respect to a point adjacent or outside the peripheral surface of the facing table. The ribs may comprise two or more sets of ribs, the ribs of one set being generally radial with respect to a point adjacent or outside the peripheral surface, and the ribs of the other set or sets being generally radial with respect to a different point or points. Said different point or points are also preferably adjacent or outside the peripheral surface.

In any of the arrangements according to the invention the rear surface of the facing table may also be formed with one or more other ribs, or protuberances, which are not generally radial with respect to said point or points. Preferably each rib is substantially continuous as it extends across the rear surface of the facing table. Preferably the ends of at least some of said ribs extend to locations at or adjacent the peripheral surface of the facing table. For example, the ends of said ribs which are further from said point may extend to locations at or adjacent the peripheral surface of the facing table, the opposite ends of the ribs, nearer said point, being spaced inwardly of the peripheral edge of the facing table.

The ends of at least some of the ribs which are nearer said point may be located on a circular arc centered on said point. For example, the ribs may comprise two or more sets of ribs, the ends of the ribs which are nearer said point, in each set, being located on circular arcs of different radii centered on said point.

Where there are two or more sets of ribs, the ribs of one set may lie interjacent ribs of another set. The ribs may be inclined at substantially equal angles to one another. Alternatively and preferably, the ends of the ribs which are located at or adjacent the peripheral surface of the facing table may be spaced apart at substantially equal distances around part of said peripheral surface.

In any of the above arrangements parts of the outer peripheral surface of the facing table may be formed with a peripheral wall portion which projects rearwardly from the periphery of the facing table. In this case the ends of at least some of the aforesaid ribs which are further from said point may intersect the peripheral wall portion. In this case, the depth of each such rib, where it intersects the peripheral wall portion, is preferably greater than the depth of the wall portion.

In any of the above arrangements at least some of the ribs may vary in depth, for example linearly, along the length thereof. At least some of the ribs may increase in depth as they extend away from said point adjacent or outside the peripheral surface of the facing table.

Each rib may taper in width, preferably outwardly, as it extends away from said point. Each rib may be generally triangular in cross-section. The apex of each rib, remote from the rear surface of the facing table, may be radiused as viewed in cross-section. One rib which extends to the peripheral surface of the facing table is preferably of different depth, for example of greater depth, than the other ribs which extend to the peripheral surface of the facing table. Preferably such rib is a center rib of a set of ribs. The different depth of the center rib may thus provide a visual indication of the location of the array of ribs in order to facilitate orientation of the preform element in use.

Some or all of said ribs may include portions of the length thereof which deviate from the radial direction with respect to said point adjacent or outside the peripheral surface of the facing table. For example, an end portion of each rib further from said point may deviate from said radial direction in a manner to approach the peripheral surface of the facing table in a direction normal thereto. Said end portions may deviate in smooth curvilinear fashion.

In any of the above arrangements there may be provided a buffer or transition layer between the superhard material and the less hard material. As is well know, such transition layers normally comprise material having one or more properties, such as coefficient of thermal expansion and/or elastic modulus, which is intermediate the corresponding properties of the superhard and less hard materials.

The buffer or transmission layer may, for the purposes of the present invention, be regarded either as a part of the facing table or as a part of the substrate. Thus, the ribs arranged according to the present invention may be provided at the interface between the superhard material and the buffer/transition layer, or between the buffer/transition layer and the less hard material, or at both said interfaces. The invention also includes within its scope arrangements where one of said interfaces is configured with ribs in accordance with the present invention and the other interface is configured, so as to be non-planar, in a different manner.

Any of the facing table, the substrate, and the buffer/transition layer may comprise a plurality of different layers or portions bonded together and do not necessarily comprise a unitary body of material.

DETAILED DESCRIPTION OF THE PREFERRED EMBODIMENTS

Figure 1:
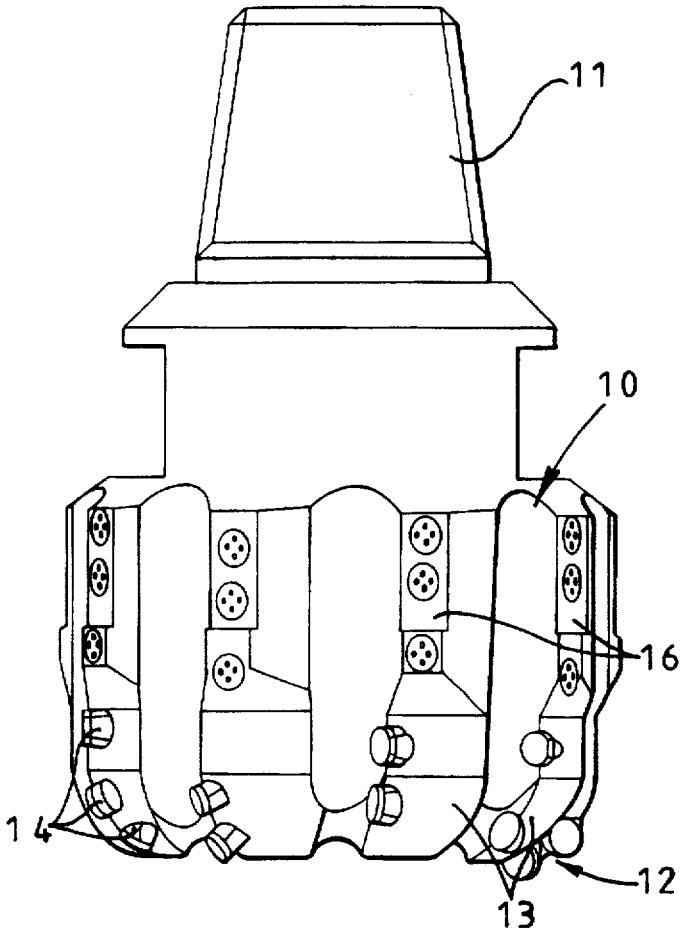
FIG. 1 is a side elevation of a typical drag-type drill bit in which preform cutting elements according to the present invention may be used.
Figure 2:
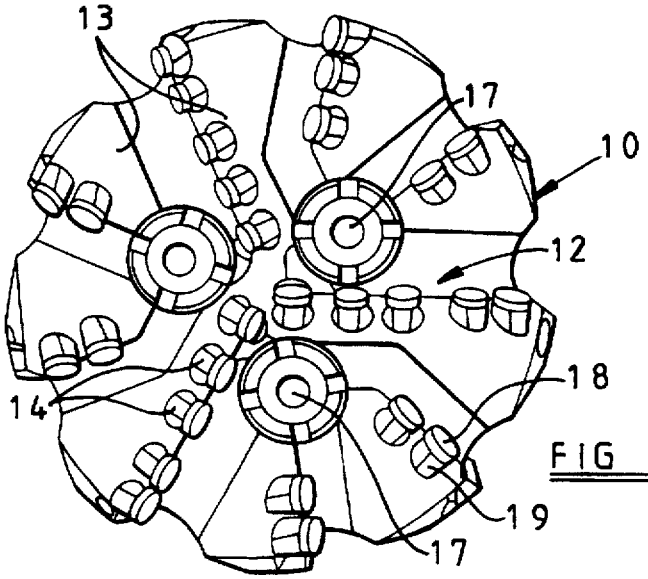
FIG. 2 is an end elevation of the drill bit shown in FIG. 1.

FIGS. 1 and 2 show a typical full bore drag-bit of a kind to which cutting elements of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilize the bit in the borehole. A central passage (not shown) in the bit and shank delivers drilling fluid through nozzles 17 in the end face 12 in known manner.

Each cutter assembly 14 comprises a preform cutting element 18 mounted on a carrier 19 in the form of a post which is located in a socket in the bit body. Each preform cutting element is in the form of a circular tablet comprising a facing table of superhard material, usually polycrystalline diamond, bonded to a substrate which is normally of cemented tungsten carbide. The rear surface of the substrate is bonded, for example by LS bonding, to a suitably orientated surface on the post 19.

One form of cutting element in accordance with the present invention is shown in FIGS. 3–6. The cutting element comprises a polycrystalline diamond front facing table 20 bonded to a cemented tungsten carbide substrate 21. The facing table 20 comprises a front flat layer 22 which provides the front cutting face 23 of the facing table, and a peripheral wall 24 is integrally formed with the front layer 22 and extends rearwardly therefrom around the periphery of the cutting element.

Also integrally formed with the front layer 22 are a plurality of ribs 25, 26 which project rearwardly from the rear surface 27 of the front layer 22 and into the substrate 21.

Figure 3:
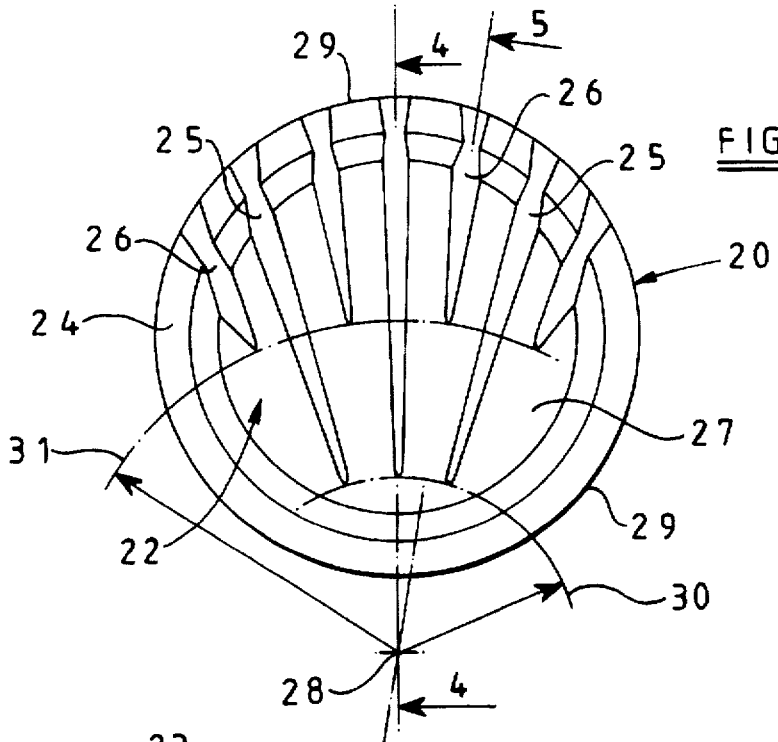
FIG. 3 is an elevation of the rear surface of the facing table of one form of preform cutting element in accordance with the present invention, the substrate being omitted.

FIG. 3 shows the rear surface of the facing table 20 formed with the peripheral wall 24 and the ribs 25, 26. As may be seen from FIG. 3, there are provided seven ribs 25, 26 all of which extend across the rear surface of the facing table in directions and which are generally radial with respect to a point 28 located outside the peripheral surface 29 of the facing table.

The ends of the ribs 25, 26 which are further from the point 28 extend to the peripheral edge 29 of the facing table and intersect the peripheral wall 24. The ends of the ribs are spaced apart at equal distances around part of the peripheral surface 29 of the facing table, for example, the distance between the ends of the ribs may subtend an angle of 20 at the center of the facing table.

The ribs 25 lie interjacent the ribs 26. The ends of the ribs 25 which are nearer the point 28 are located on a circular arc 30 centered on the point 28. The radius of the arc 30 is such that the nearer ends of the ribs 25 are spaced inwardly from the peripheral wall 24 of the facing table.

The other ribs 26 have their nearer ends located on an arc 31 which is also centered on the point 28, but which is of greater radius than the arc 30 so that the ribs 26 are shorter than the ribs 25, their ends being spaced a greater distance from the point 28. The ribs 25 and 26 taper outwardly slightly as they extend away from the point 28.

Figure 4:
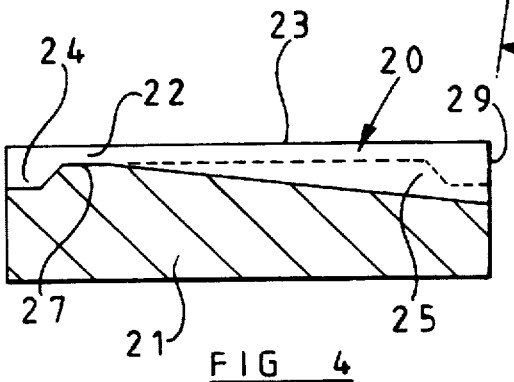
FIG. 4 is a section on the Line 4—4 of FIG. 3, but showing the complete cutting element including the substrate.
Figure 5:
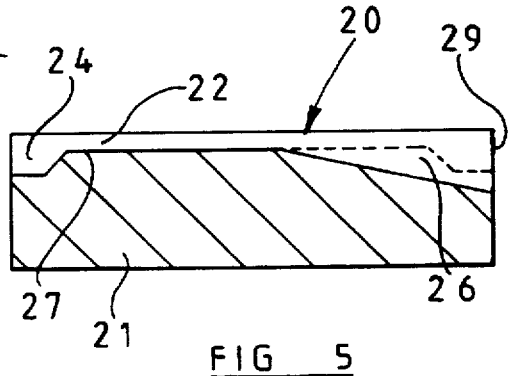
FIG. 5 is a similar sectional view along the Line 5—5 of FIG. 3.

As best seen in FIGS. 4 and 5, the ribs 25 and 26 also increase in depth as they extend away from the point 28 towards the opposite peripheral surface 29 of the facing table. In the arrangement shown the ribs increase linearly in depth so that their lower edges are straight. However, in alternative arrangements the lower edges of the ribs may be curved, preferably concavely curved. For example, the lower edges of the ribs may follow a part circular or parabolic curve.

Figure 6:
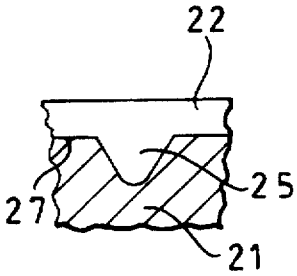
FIG. 6 is a cross-section, on an enlarged scale, through part of the cutting element.

As shown in FIG. 6, the ribs are generally triangular as viewed in cross-section, the apex of each rib, remote from the rear surface of the facing table, being radiused. The ribs may also be of any other suitable cross-sectional shape, e. g. they may be generally rectangular or U-shaped in cross-section.

The maximum depth of the ribs 25 or 26 at the peripheral surface 29 of the facing table may be the same. Since the ribs are of different lengths, this means that the longitudinal shapes of the rib are different. Preferably, however, one of the ribs, and preferably the central rib 25, has a depth at the peripheral surface 29 which is greater (or less) than the depth of the other ribs. This therefore provides a visual indication of where the center of the array of ribs is, and this can assist in orientating the cutting element on its carrier or when mounting it on the drill bit. It is desirable that the portion of the periphery of the cutting element where the ribs intersect the peripheral surface 29 is used as the cutting edge of the cutting element in use.

Figure 7:
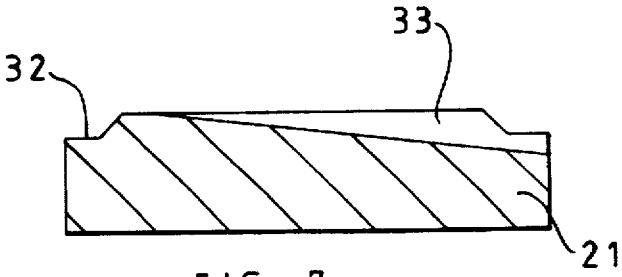
FIG. 7 is a section through a preformed substrate for use in the manufacture of the cutting element of FIGS. 3–6.

In one method of manufacturing a cutting element of the kind shown in FIGS. 3–6, a substrate 21 is first preformed by machining or molding to the shape shown in FIG. 7. Thus, the substrate 21 comprises basically a circular disc of cemented tungsten carbide formed around its periphery with an annular groove 32 of complementary shape to the peripheral wall 24, and across its upper surface with grooves 33 complementary in shape and arrangement to the ribs 25, 26 on the rear surface of the facing table.

The preformed substrate 21 is then placed in a mold and, in known manner, diamond particles are packed in a layer above the substrate so as to fill the annular groove 32 and the grooves 33 and to form a flat top layer above the substrate. The substrate and diamond layer is then subjected to extremely high pressure and temperature in a press so that diamond-to-diamond bonding occurs between the diamond particles to form a facing layer of polycrystalline diamond which is bonded to the substrate 21. The preform substrate 21 thus acts as a mold to form the peripheral wall 24 and ribs 25, 26 on the rear surface of the diamond layer.

As previously mentioned, some or all of the ribs 25, 26 may include portions which deviate from the radial direction with respect to the point 28. For example, an end portion of each rib at the end further from the point 28 may curve smoothly outwardly away from the radial direction so as to approach the peripheral surface 29 of the facing table in a direction normal thereto.

Instead of all the ribs 25, 26 being radial with respect to a single point 28, as shown in FIG. 3, some ribs may be radial with respect to one point and other ribs may be radial with respect to another point. For example, in the arrangement shown, the longer ribs 25 may extend radially with respect to a point which is spaced from the point 28. For example, the other point may be further from the peripheral surface 29 of the facing table than the point 28. The two or more points with respect to which the ribs are radial may lie on a common diametral line. Alternatively they may lie on different diametral lines, in which case the two or more sets of ribs may intersect as they extend across the surface of the facing table.

In cases where the ribs are in two or more sets which are radial with respect to different points, it is only necessary for the purposes of the invention for at least one of said points to be adjacent or outside the peripheral surface of the facing table. Although the other point or points may also be adjacent or outside the peripheral surface of the facing table, as previously mentioned the invention includes arrangement where said other point or points are located elsewhere, for example within the facing table.

Preferably the array of ribs, or each array of ribs, is substantially symmetrical with respect to the diametral line on which the point from which they radiate lies., as in the arrangement of FIG. 3. However, in some cases the ribs may be asymmetrical with respect to that diametral line. For example, the number and/or spacing of the ribs may be different on each side of the diametral line. The facing table may also be formed with one or more other ribs, or protuberances, which are not arranged according to the present invention.

A buffer or transition layer may be provided between the superhard material of the facing table 20 and the less hard material of the substrate 21. In the case where the ribs are formed on the rear surface of the superhard material, the buffer/transition layer may be regarded as forming part of the substrate. Conversely, the ribs may be formed at the interface between the buffer/transition layer and the substrate 21, in which case the buffer/transition layer may be regarded as forming part of the facing table. In either case, the interface between the buffer/transition layer which is not formed with ribs in accordance with the present invention may be otherwise configured to provide a non-planar interface. Alternatively, both interfaces may be formed with ribs arranged in accordance with the present invention.

Whereas the present invention has been described in particular relation to the drawings attached hereto, it should be understood that other and further modifications, apart from those shown or suggested herein, may be made within the scope and spirit of the present invention.

What is claimed:

1. A preform element including a facing table of superhard material having a front face, a peripheral surface, and a rear surface bonded to a substrate which is less hard than the superhard material, the rear surface of the facing table being integrally formed with at least one set of ribs comprising a plurality of ribs which project into the substrate, at least major portions of the ribs in said set being inclined to one another and extending across the rear surface of the facing table in directions which are generally radial with respect to a common point which is located adjacent or outside the peripheral surface of the facing table.

2. A preform element according to claim 1, wherein the ribs comprise at least two sets of ribs, the ribs of one set being generally radial with respect to a point adjacent or outside the peripheral surface, and the ribs of the other set or sets being generally radial with respect to a different point or points.

3. A preform element according to claim 2, wherein said different point or points are also adjacent or outside the peripheral surface.

4. A preform element according to claim 1, wherein the rear surface of the facing table is also formed with at least one other rib which is not generally radial with respect to said point.

5. A preform element according to claim 1, wherein each rib is substantially continuous as it extends across the rear surface of the facing table.

6. A preform element according to claim 1, wherein the ends of at least some of said ribs extend to locations at or adjacent the peripheral surface of the facing table.

7. A preform element according to claim 1, wherein the ends of said ribs which are further from said point extend to locations at or adjacent the peripheral surface of the facing table, the opposite ends of the ribs, nearer said point, being spaced inwardly of the peripheral edge of the facing table.

8. A preform element according to claim 1, wherein the ends of at least some of the ribs which are nearer said point are located on a circular arc centered on said point.

9. A preform element according to claim 8, wherein the ribs comprise two or more sets of ribs, the ends of the ribs which are nearer said point, in each set, being located on circular arcs of different radii centered on said point.

10. A preform element according to claim 1, wherein there are two or more sets of ribs, and the ribs of one set lie interjacent ribs of another set.

11. A preform element according to claim 1, wherein the ribs are inclined at substantially equal angles to one another.

12. A preform element according to claim 1, wherein the ends of said ribs which are further from said point extend to locations at or adjacent the peripheral surface of the facing table, and are spaced apart at substantially equal distances around part of said peripheral surface.

13. A preform element according to claim 1, wherein parts of the outer peripheral surface of the facing table are formed with a peripheral wall portion which projects rearwardly from the periphery of the facing table.

14. A preform element according to claim 13, wherein the ends of at least some of the aforesaid ribs which are further from said point intersect the peripheral wall portion.

15. A preform element according to claim 1, wherein at least some of the ribs vary in depth along the length thereof.

16. A preform element according to claim 1, wherein least some of the ribs increase in depth as they extend away from said point adjacent or outside the peripheral surface of the facing table.

17. A preform element according to claim 1, wherein each rib tapers in width as it extends away from said point.

18. A preform element according to claim 1, wherein each rib is generally triangular in cross-section.

19. A preform element according to claim 1, wherein the apex of each rib, remote from the rear surface of the facing table, is radiused as viewed in cross-section.

20. A preform element according to claim 1, wherein at least some of said ribs include portions of the length thereof which deviate from the radial direction with respect to said point adjacent or outside the peripheral surface of the facing table.

21. A preform element according to claim 20, wherein an end portion of each rib further from said point deviates from said radial direction in a manner to approach the peripheral surface of the facing table in a direction normal thereto.

22. A preform element according to claim 1, wherein there is provided a transition layer between the superhard material and the less hard material.

23. A preform element according to claim 22, wherein the transition layer comprises material having at least one property which is intermediate the corresponding properties of the superhard and less hard materials.

24. A preform element according to claim 1, wherein at least one of the facing table and substrate comprises a plurality of different portions bonded together.

25. A preform element including a facing table of superhard material having a front face, a peripheral surface, and a rear surface bonded to a substrate which is less hard than the superhard material, the rear surface of the facing table being integrally formed with a plurality of ribs which project into the substrate, wherein at least major portions of said ribs extend across the rear surface of the facing table in directions which are generally radial with respect to at least one point which is adjacent or outside the peripheral surface of the facing table, wherein the ends of at least some of the aforesaid ribs which are further from said point intersect the peripheral wall portion, and wherein the depth of each such rib, where it intersects the peripheral wall portion, is greater than the depth of the wall portion.

26. A preform element including a facing table of superhard material having a front face, a peripheral surface, and a rear surface bonded to a substrate which is less hard than the superhard material, the rear surface of the facing table being integrally formed with a plurality of ribs which project into the substrate, wherein at least major portions of said ribs extend across the rear surface of the facing table in directions which are generally radial with respect to at least one point which is adjacent or outside the peripheral surface of the facing table, and wherein one rib which extends to the peripheral surface of the facing table is of different depth from the other ribs which extend to the peripheral surface of the facing table.

27. A preform element according to claim 26, wherein the rib of different depth is a center rib of a set of ribs, so as to provide a visual indication of the location of the array of ribs in order to facilitate orientation of the preform element in use.

* * * * *